United States Patent [19]

Fiedler et al.

[11] 4,060,959

[45] Dec. 6, 1977

[54] WRAPPER END FOLDING AND SEALING APPARATUS

[75] Inventors: Edgar F. Fiedler; Gordon A. Copas, both of Rockford, Ill.; Arthur F. Willey, Grafton, Wis.

[73] Assignee: Anderson Bros. Mfg. Co., Rockford, Ill.

[21] Appl. No.: 700,757

[22] Filed: June 29, 1976

[51] Int. Cl.[2] ..... B65B 11/12; B65B 51/14

[52] U.S. Cl. ..... 53/373; 53/209

[58] Field of Search ..... 53/373, 39, 374, 375, 53/376, 379, 180 R, 182 R, 209, 224, 226, 233, 290, 284, 387, 388; 156/477, 583, 522; 198/460, 729

[56] References Cited

U.S. PATENT DOCUMENTS

| | | | |
|---|---|---|---|
| 2,617,240 | 11/1952 | Monaco | 53/379 |
| 2,890,555 | 6/1959 | Hayssen | 53/228 |
| 3,191,356 | 6/1965 | Zelnick et al. | 53/182 |
| 3,511,024 | 5/1970 | Manspeaker et al. | 53/182 |
| 3,692,608 | 9/1972 | Risgaard | 156/583 X |
| 3,808,767 | 5/1974 | Reid | 53/375 X |

*Primary Examiner*—Travis S. McGehee
*Assistant Examiner*—Horace M. Culver
*Attorney, Agent, or Firm*—Morsbach & Pillote

[57] ABSTRACT

Apparatus for folding and sealing upper and lower end portions of a wrapper of heat sealable plastic film which has previously been positioned about the top, bottom and sides of the article. The wrapper end folding and sealing apparatus includes an endless type article conveyor arranged to advance the articles and wrapper along a path with the end portions of the wrapper extending laterally from opposite sides of the article conveyor; endless type upper and lower finger conveyors disposed at each side of the article conveyor and having film folding fingers arranged to engage the laterally extending end portions of the wrapper to fold the end portions of the wrapper into overlapping relation at the ends of the article as they are advanced by the article conveyor, and heat sealing members for sealing the overlapping portions of the wrapper at the ends of the articles as they are advanced.

10 Claims, 10 Drawing Figures

WRAPPER END FOLDING AND SEALING APPARATUS

BACKGROUND OF THE INVENTION

There are a number of machines, for example as shown in U.S. Pat. Nos. 3,453,801 and 3,553,059, assigned to the assignee of the present invention, which operate to wrap articles in an open ended generally tubular wrapper of heat shrinkable plastic film, herein sometimes referred to as a sleeve wrapper. In many installations, the sleeve wrapped articles are passed through a shrink tunnel without first closing the ends of the sleeve wrapper, and this produces a shrink-film wrapper which snugly engages the article but which has openings at the ends. It is desired in some applications to provide shrink-film wrappers that are closed on all sides and several different systems have heretofore been proposed for closing the ends of the open-ended wrapper prior to heat shrinking.

Some machines such as disclosed in U.S. Pat. Nos. 3,191,356 and 3,643,396 close the ends of the open-ended wrapper by pressing the upper and lower end portions of the wrapper into face-to-face contact, and then sealing the contacting faces and trimming the excess material from the wrapper. Such apparatus use wrapping material which is substantially wider than that which would otherwise be required to merely cover the top and ends of the article. Moreover, such apparatus usually require an additional trimming operation with the attendant problems of removing the trimmed material, in order to provide a neat package.

It has also been proposed, for example as shown in U.S. Pat. No. 3,739,547, to use stationary plows to fold the ends of an open-ended wrapper into overlapping relation at the ends of the article while the articles are advanced past the plows. While stationary plows work quite well with wrappers formed of relatively stiff material such as paper, difficulties are encountered when attempts are made to use stationary plows for folding relatively thin and flimsy plastic material such as is commonly utilized in shrink-film wrapping. Such thin and light weight plastic films tend to cling to the stationary plows as the articles are advanced past the plows and this causes numerous irregular folds and creases to be formed in the projecting ends of the sleeve material. The creases and folds in the ends of the wrapper not only adversely affect the appearance of the package, but also make it difficult to reliably seal the overlapping portions of the film together.

SUMMARY OF THE INVENTION

The present invention relates generally to apparatus for folding and sealing upper and lower end portions of a heat sealable wrapper which has previously been positioned about the top and bottom of the article. It is the general object of the present invention to overcome the disadvantages of the prior art by providing an improved wrapper end folding and sealing apparatus which folds and seals the upper and lower end portions of a wrapper of heat shrinkable plastic film into overlapping relation while the articles are being advanced and in such a manner as to minimize multiple layer folds or creases at the ends of the package and thereby improve the appearance of the package and facilitate reliable heat sealing of the overlapping portions of the projecting ends of the package.

Accordingly, the present invention provides an apparatus for folding and sealing the end portions of a heat sealable wrapper at the ends of the articles while they are advanced, which apparatus includes an endless type article conveyor for advancing the articles and wrapper along a generally horizontal path with the end portions of the wrapper extending laterally from the article conveyor, endless type upper and lower finger conveyors disposed alongside the article conveyor with the upper and lower finger conveyors having inlet runs that converge in the forward direction respectively from above and below the upper run of the article conveyor, and forward runs extending forwardly from the respective inlet runs, and a plurality of film folding fingers extending downwardly and upwardly respectively from the upper and lower finger conveyors as they move along the inlet and forward runs thereof for engaging the extending ends of the wrapper to fold the upper and lower end portions of the wrapper respectively downwardly and upwardly into overlapping relation at the ends of the article, and wrapper seal means for sealing the overlapping upper and lower end portions of the wrapper to each other as the articles are advanced by the article conveyor.

Provision is made for effecting sequential folding of the lower and upper end portions of the wrapper by holding the upper end portion in a raised position while the lower end portion is folded upwardly against the ends of the articles and for thereafter folding the upper end portion downwardly into overlapping relation with the lower end portion of the wrapper. Heat sealing is advantageously effected during advance of the articles and while the overlapping upper and lower end of the wrapper are held in overlapping relation by the film folding fingers on the finger conveyors.

These, together with other objects and features of the present invention will be more readily understood by reference to the following detailed description when taken in connection with the accompanying drawings wherein.

The wrapper end folding and sealing apparatus of the present invention is generally adapted for folding and sealing the end portions of an open-ended wrapper of heat sealable material and may, for example be used for closing the open end of a bag type wrapper or for closing opposite ends of a tubular sleeve type wrapper. In the preferred embodiment illustrated and described herein, the wrapper end folding and sealing apparatus is arranged to simultaneously fold and seal opposite ends of a tubular sleeve wrapper, it being understood that the end folding and sealing apparatus could also be adapted for closing other types of open-ended wrappers such as the open end of a bag type wrapper. The articles designated A can comprise a single item or a group of items. The wrapper is preferably of a heat shrinkable thermoplastic film such as polyethylene, polyvinychloride, polypropylene, polyester, etc. Such heat shrinkable films are stretched or oriented in either or both lengthwise and cross directions and the amount of stretch can be nearly equal in both directions (balanced) or more in one direction than in the other direction. Such heat shrinkable films, when heated, will shrink and form a tight wrap around the articles.

Figure 1:
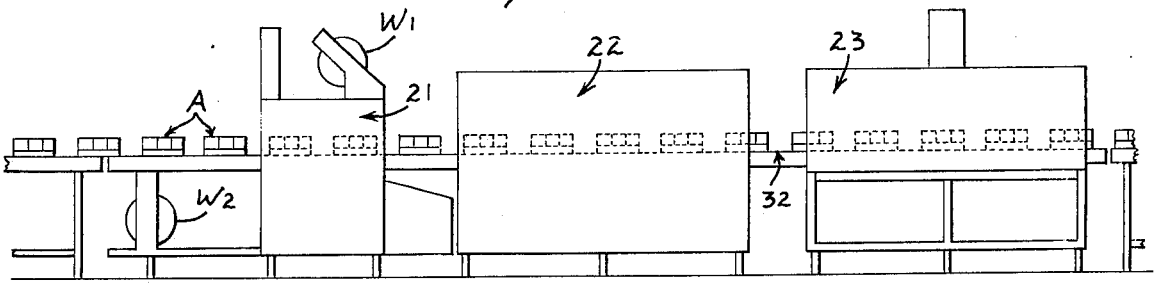
FIG. 1 is a diagrammatic view of an article wrapping system in which the apparatus for folding the end portions of the wrapper is interposed between an apparatus for wrapping the articles in a sleeve wrapper and the heat shrinking apparatus.
Figure 2:
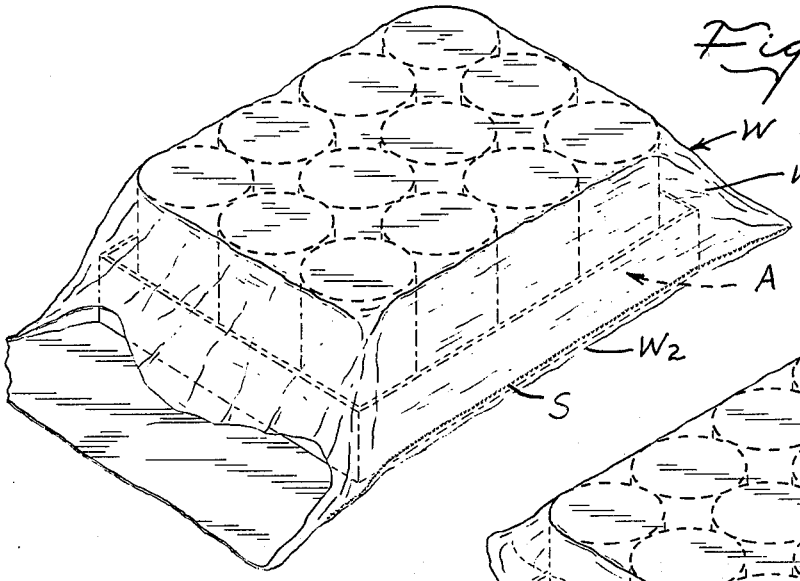
FIG. 2 is a perspective view illustrating an article enclosed in a sleeve wrapper of heat shrinkable plastic film.
Figure 3:
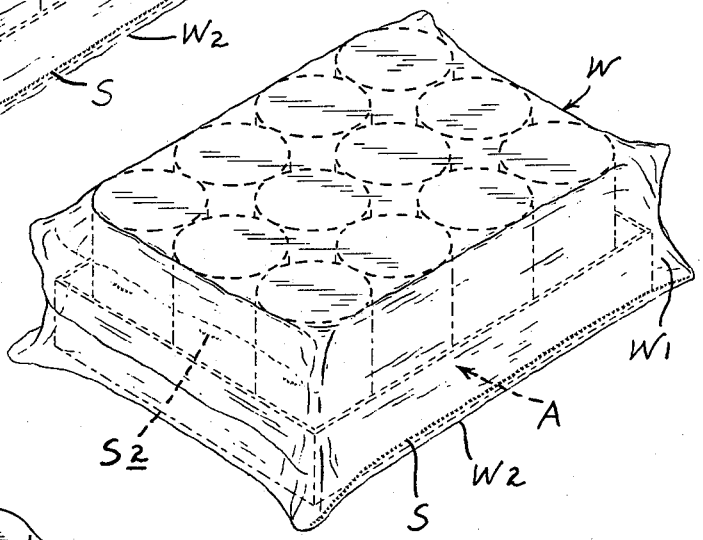
FIG. 3 is a perspective view illustrating an article with the ends of the sleeve wrapper closed.

Referring now more specifically to FIG. 1, the numeral 21 illustrates a sleeve wrapping apparatus for enclosing the articles in a tubular wrapper W of heat shrinkable plastic film to form a sleeve type wrap in which the ends of the sleeve wrapper project beyond the ends of the article; the numeral 22 designates the apparatus of the present invention for folding the upper and lower portions of the extending ends of the sleeve wrapper into overlapping relation and for sealing the overlapping portions at the ends of the articles; and the numeral 23 designates a heat tunnel for heating the wrapper to shrink the same around the articles. The sleeve wrapping apparatus 21 is preferably of the type which effects wrapping of the articles while they are in motion and the sleeve wrapping apparatus may, for example, be of the type shown in the U.S. Pat. No. 3,453,801 to Roger H. Stohlquist for "Method and Apparatus for Wrapping Articles", issued July 8, 1969, to which reference is hereby made for a more complete description of its construction and operation. In general, the sleeve wrapping apparatus 21 operates to seal upper and lower webs designated W1 and W2 in FIGS. 2-4 together along seam lines S at the lead and trail sides of the article to form a tubular sleeve like wrapper around the article, and to sever the wrapped article from the remainder of the webs. In order to enable the end folding apparatus 22 of the present invention to close the ends of the wrapper, the width of the upper and lower webs W1 and W2 are selected to be greater than the length of the article and such that the ends of the tubular wrapper extend beyond the ends of the article a distance somewhat greater than one-half the height of the article so that the upper and lower portions of the extending ends of the wrapper can be folded into overlapping relation at the ends of the articles. The articles A, after they are enclosed in a tubular wrapper W by the sleeve wrapping apparatus 21, are advanced to the end folding apparatus 22.

Figure 5:
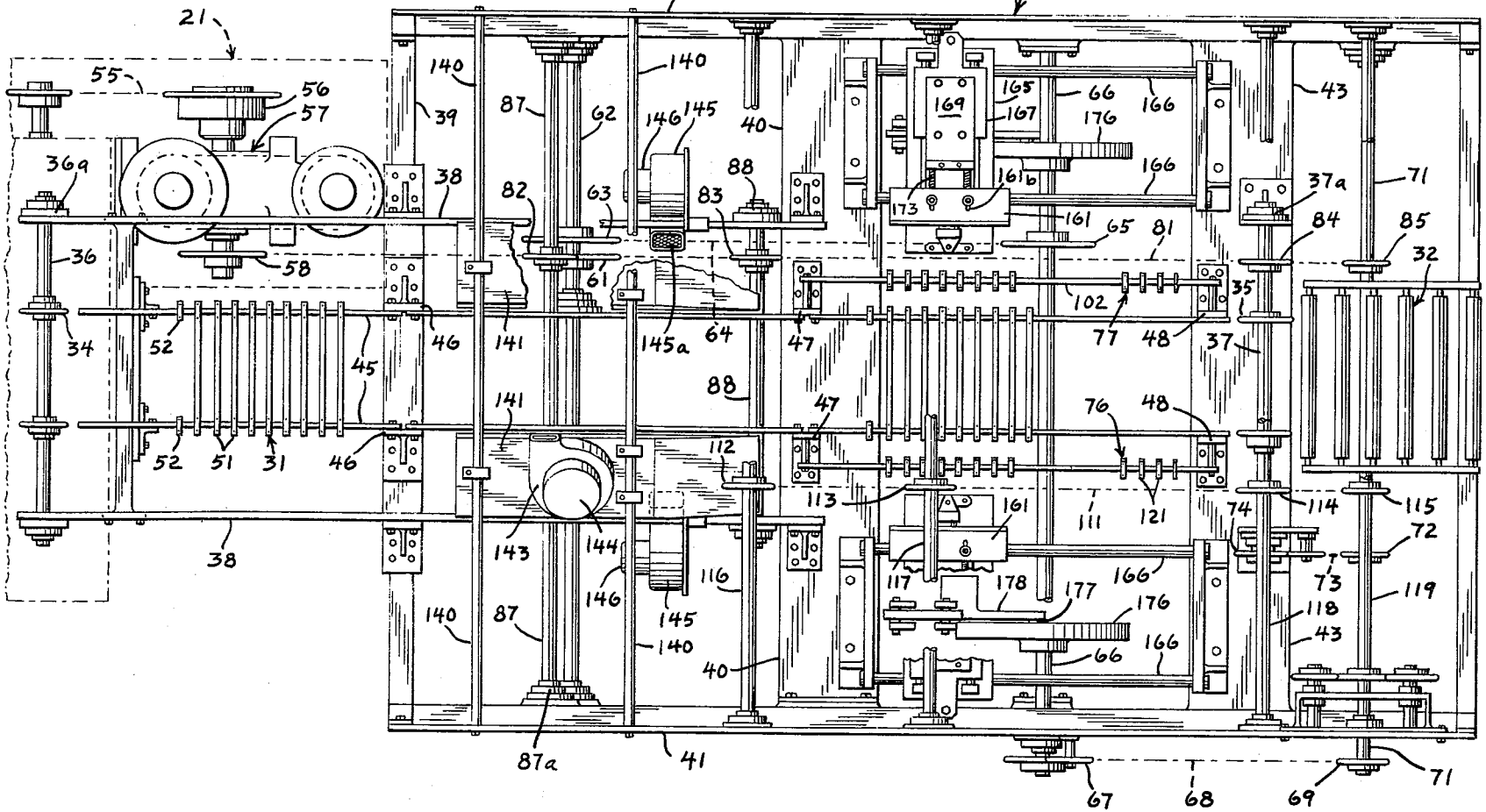
FIG. 5 is a top plan view of the apparatus for folding the ends of the wrapper with parts broken away along the section 5—5 of FIG. 8 to illustrate details of construction.
Figure 6:
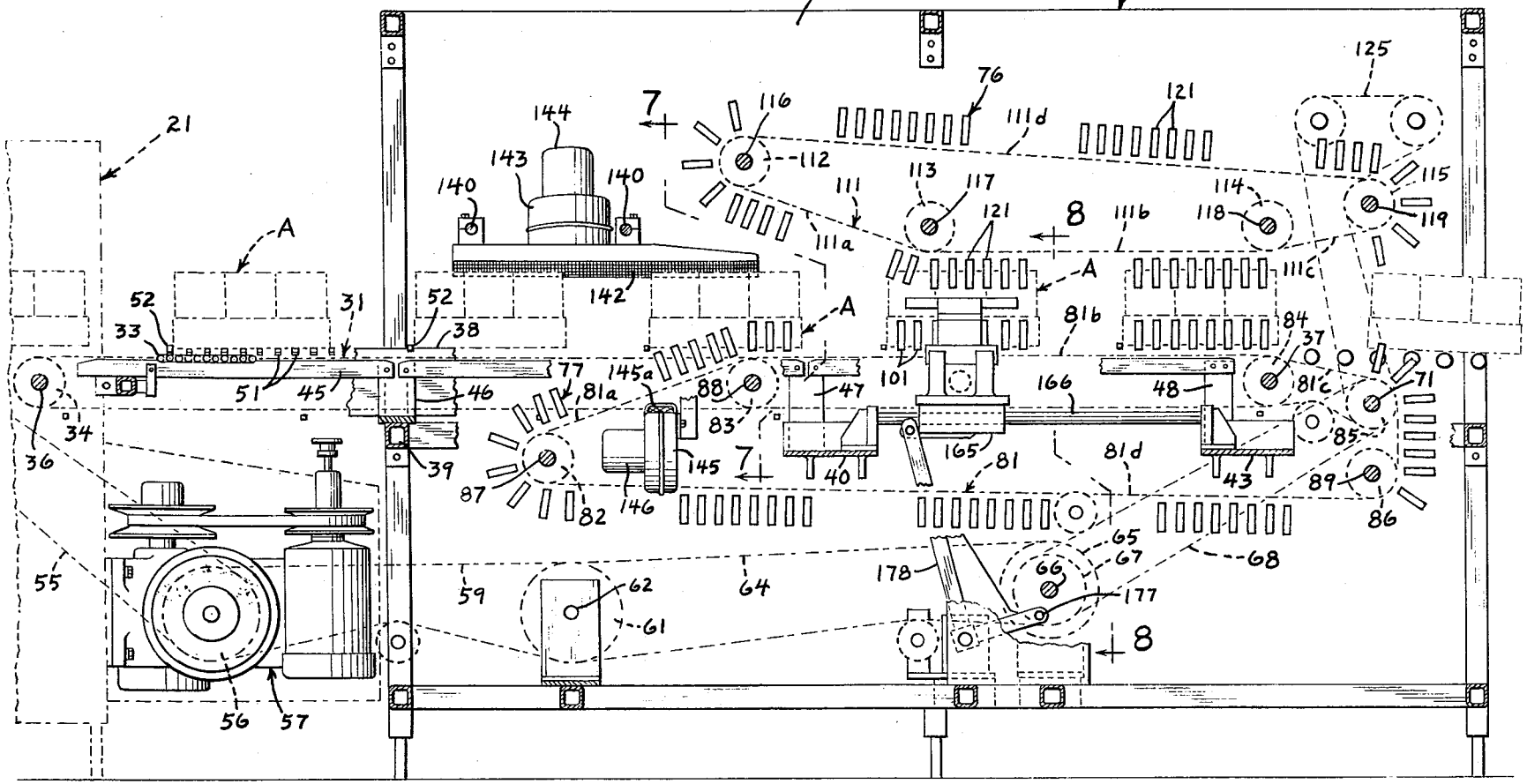
FIG. 6 is a longitudinal sectional view taken on the plane 6—6 of FIG. 5.

The wrapper end folding apparatus 22 of the present invention is arranged to fold the upper and lower portions of the extending ends of the sleeve wrapper against the ends of the article A and to seal the same while the articles are advanced. The wrapper end folding apparatus 22 includes an article conveyor 31 that extends from the outlet of the sleeve wrapper 21, to an outlet conveyor 32 leading to the heat tunnel 23. The article conveyor 31 is of the endless type and includes a pair of spaced roller chains 33 entrained over inlet and outlet sprockets 34 and 35 secured to shafts 36 and 73 respectively. As best shown in FIG. 5, shaft 36 is journaled in bearings 36*a* on side frame members 38 mounted on cross members 39 and 40 that extend between the spaced side panels 41 of the main frame. Shaft 37 is journaled on bearings 37*a* mounted on cross member 43 that also extends between the side panels 41. The upper runs of the chains 33 are supported on horizontal guide rails 45 that extend lengthwise of the machine and the guide rails are supported as by brackets 46, 47 and 48 on the cross members 39, 40 and 43, respectively. The article conveyor includes a plurality of slats 51 that extend between the conveyor chains 33 and which are arranged to underlie and support the articles, and pusher bars 52 that are attached to the conveyor chains at locations spaced along the conveyor chains a distance greater than the width of the articles, and which pusher bars are arranged to engage the trailing side of the articles to positively advance the articles therewith while maintaining the articles in spaced relation as they advance through the end folding apparatus. The article conveyor of the end folding apparatus 22 is driven at a speed correlative with the speed of the sleeve wrapper 21 so as to effect closing of the ends of the wrapper at the same speed at which the articles are sleeve wrapped. As best shown in FIGS. 5 and 6, the end folder 22 is conveniently driven from a power take-off chain 55 from the sleeve wrapper 21, the take-off chain being connected to the input sprocket 56 of a variable speed drive 57, the output shaft of which is connected to an output sprocket 58. The output sprocket 58 is connected through a chain 59 to an intermediate sprocket 61 on a shaft 62 and a second intermediate sprocket 63 on the shaft 62 is connected through a chain 64 to a sprocket 65 on a cam shaft 66. A sprocket 67 on the end of the cam shaft 66 is connected through chain 68 to a sprocket 69 on cross shaft 71 and a sprocket 72 on the cross shaft 71 is connected through a chain 73 to sprocket 74 on the article conveyor shaft 37 to drive the same. The variable speed drive 57 is conveniently of the Reeves type using variable diameter pulleys and is adjustable so that the end folder advances the articles at the same speed as they are formed by the sleeve wrapper 21.

Figure 7:
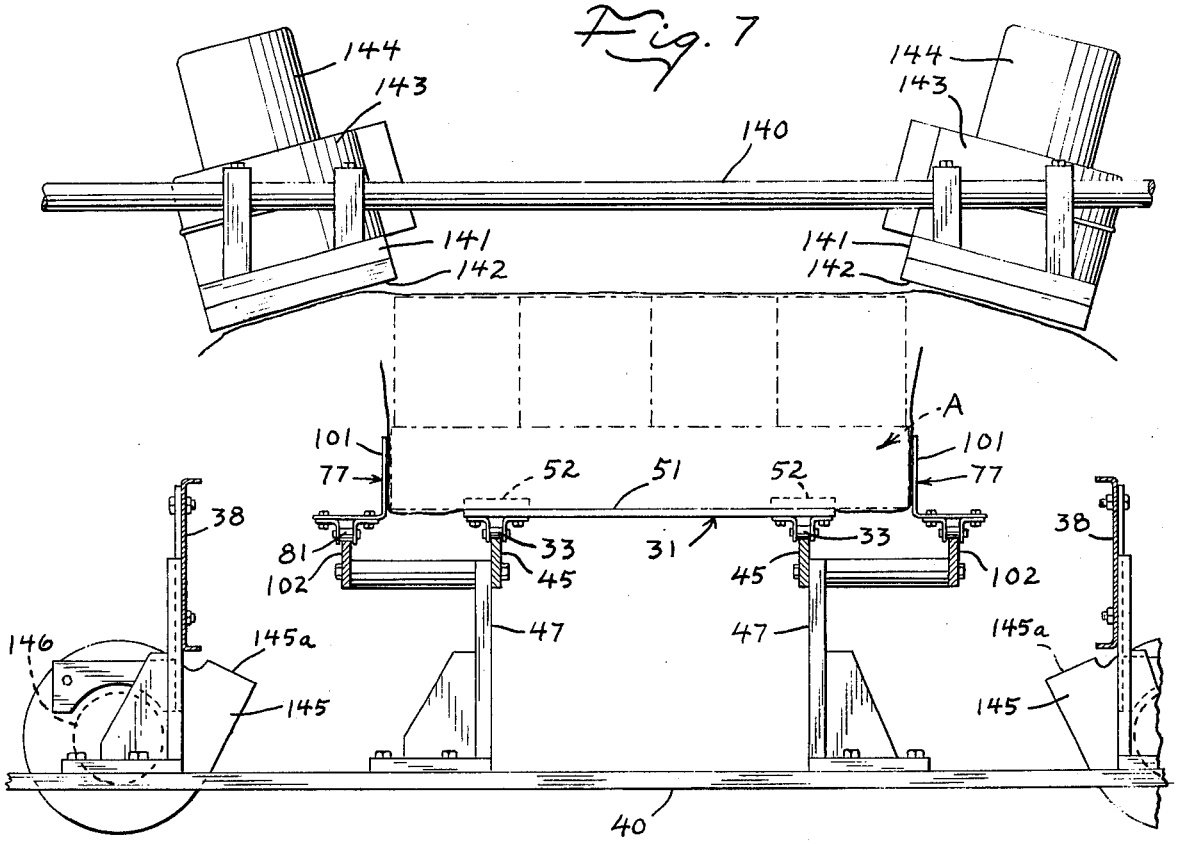
FIG. 7 is a fragmentary transverse sectional view taken on the plane 7—7 of FIG. 6.

The article conveyor has a width less than the length of the articles and advances the articles after they have been enclosed in the tubular sleeve wrapper with the ends of the wrapper extending laterally from opposite sides of the article conveyor. Endless type upper and lower finger conveyors 76 and 77 are disposed at each side of the article conveyor for folding the projecting end portions of the wrapper as the articles are advanced. The lower finger conveyors 77 each include an endless type roller chain 81 entrained over sprockets 82, 83, 84, 85, and 86. Sprockets 82 are secured to a cross shaft 87 journaled in bearings 87*a* on the side panels 41 at a level substantially below the upper run of the article conveyor. Sprockets 83 are secured to a cross shaft 88 journaled by bearings 88*a* in the side frame members 38 at a level adjacent the level of the article conveyors so that the inlet run 81*a* of the lower finger conveyor is inclined upwardly and forwardly in the direction of advance of the articles on the article conveyor to converge relative thereto. Sprockets 84 are secured to the conveyor cross shaft 37 to rotate therewith and are disposed at a level such that the run 81*b* of the lower finger conveyor extends forwardly from the inlet run 41*a* generally parallel to the upper run of the article conveyor. Sprockets 85 are mounted on cross shaft 71 which is preferably offset slightly below the level of the shaft 37 so that the outlet run 81*c* of the lower finger conveyor is inclined downwardly and forwardly relative to the path of advance of the articles on the article conveyor. Sprockets 86 are mounted on the cross shaft 89 below the cross shaft 71 and the lower finger conveyors extend downwardly around sprockets 86 and then back to the sprocket 82 in a return run 81*d*. The lower finger conveyors have a plurality of film folding fingers mounted thereon and, as shown, the fingers have a generally L-shaped configuration with one leg attached to the respective chain and the other leg arranged to extend upwardly from the chain as it advances along the inlet and forward runs 81*a* and 81*b* thereof. The lower finger conveyors are offset outwardly from the article conveyor at a location such that the fingers 101 are disposed alongside the ends of the articles A. The lower finger conveyors are guided along their upper runs on guide rails 102 (FIGS. 7–9) conveniently supported on the brackets 47 and 48. The film folding fingers 101 are preferably arranged in groups that are pitched along the lower finger conveyor a distance corresponding to the pitch of the article pusher members 52 on the article conveyor and, for reasons pointed out more fully hereinafter, the lower finger conveyors 77 are timed with relation to the article conveyor 31 so that the trail finger in each group is disposed somewhat in advance of the article pusher 52 on the article conveyor. This is to avoid folding the wrapping material at the trail corner of the package forwardly.

The upper finger conveyor 76 similarly includes endless chains 111 entrained over sprockets 112, 113, 114, and 115. As best shown in FIG. 6, sprockets 112–115 are mounted on cross shafts 116–119, respectively and the cross shafts are journaled in bearings on the side panels 41 at locations such that the inlet runs 111*a* of the upper finger conveyors are inclined downwardly and forwardly in the direction of advance of the articles toward the upper run of the article conveyor and the upper finger conveyors have a forward run 111*b* that extends generally horizontally from the inlet run 111*a*, with an outlet run 111*c* inclined upwardly relative to the article conveyor, and a return run 111*d*. The forward run 111*b* of the upper finger conveyor 76 is spaced a substantial distance above the forward run 81*b* of the lower finger conveyor 77 and is also preferably spaced above the level of the articles A on the article conveyor 31. A plurality of film folding fingers 121 are also provided on the upper finger conveyor and the fingers 121 have a generally L-shaped configuration with one leg attached to the respective chain and the other leg extending downwardly from the chain as the upper finger conveyors advance along the inlet and forward runs thereof. The upper finger conveyors are also preferably arranged in groups as described in connection with the lower finger conveyor. In order to effect sequential folding of the lower and upper portions of the extending ends of the wrapper, the inlet runs 111*a* of the upper finger conveyor are offset in a direction lengthwise of the path of travel of the articles from the inlet runs 81*a* of the lower finger conveyor. In the embodiment shown, the end folding apparatus is arranged to first fold the lower portion of the wrapper upwardly against the articles and thereafter fold the upper portion of the wrapper downwardly into overlapping relation with the lower portion and the inlet run 111*a* of the upper finger conveyor is accordingly offset in a forward direction relative to the path of travel from the inlet run 81*a* of the lower finger conveyor. As shown in FIG. 6 the upper finger conveyor 76 is driven in timed relation with the lower finger conveyor 77 as by a chain 125 that drivingly interconnects shafts 71 and 119.

In order to facilitate sequential folding of the lower and upper portions of the projecting ends of the wrapper, provision is made for raising the upper portions of the projecting ends of the wrapper to an out-of-the-way position prior to folding of the lower portion upwardly against the ends of the articles. For this purpose, suction boxes 141 are mounted as on cross bars 140 at opposite sides of the article conveyor, at locations above the inlet runs of the lower finger conveyors and at a level adjacent the top of the articles. The suction boxes each have a downwardly facing inlet covered by a screen 142 and a means is provided for withdrawing air from the suction boxes to tend to lift and hold the upper portions of the ends of the wrapper against the screws 142. For this purpose, blowers 143 driven by motors 144 are provided with their inlets connected to a respective suction box. A second blower 145 driven by a motor 146 is advantageously provided at each side of the article conveyor 31, at a level below the level of the article conveyor, and with the outlets 145*a* of the blower 145 directed upwardly and toward the end of the articles to aid in lifting the upper portion of the projecting end of the wrapper into engagement with the screen at inlet of the suction box, while also urging the lower portion of the projecting end of the wrapper upwardly toward the end of the article.

The film folding fingers 101 on the lower finger conveyors 77 engage the lower portion of the projecting ends of the wrapper and draw it upwardly against the ends of the article. Moreover, as will be seen from FIG. 6, the tips of the lower film folding fingers 101 move through an arc as the fingers move from the upwardly inclined inlet run 81*a* to the generally horizontal forward run 81*b* and this produces a wiping action that aids in smoothing any folds or wrinkles that may otherwise occur in the film. The suction box 141 terminates adjacent the end of the inlet run of the lower finger conveyor, and the upper finger conveyor thereafter moves downwardly along its inlet run 111*a* to fold the upper portion of the wrapper downwardly into overlapping relation with the lower portion. The fingers on the upper finger conveyor also move through an arc as they pass from the inlet run to the forward run thereof and produce a wiping action on the wrapper to tend to draw out any folds or wrinkles.

Figure 10:
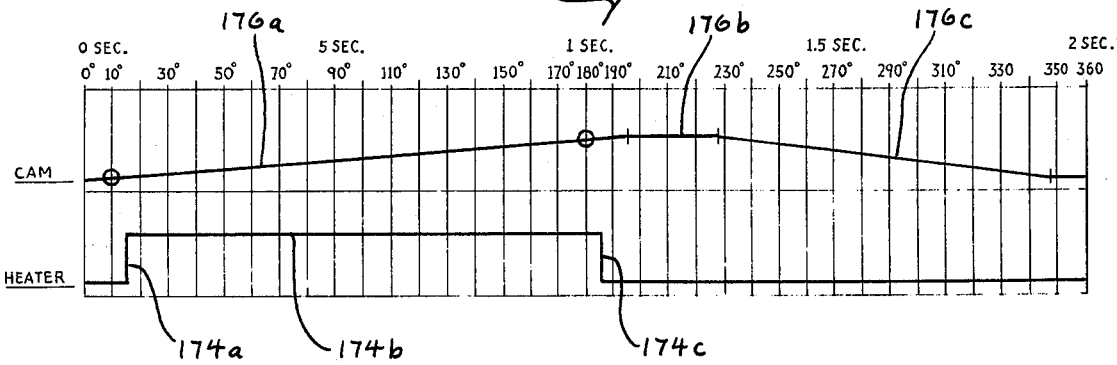
FIG. 10 is a timing diagram of the heat sealing jaw.
Figures 8, 9:
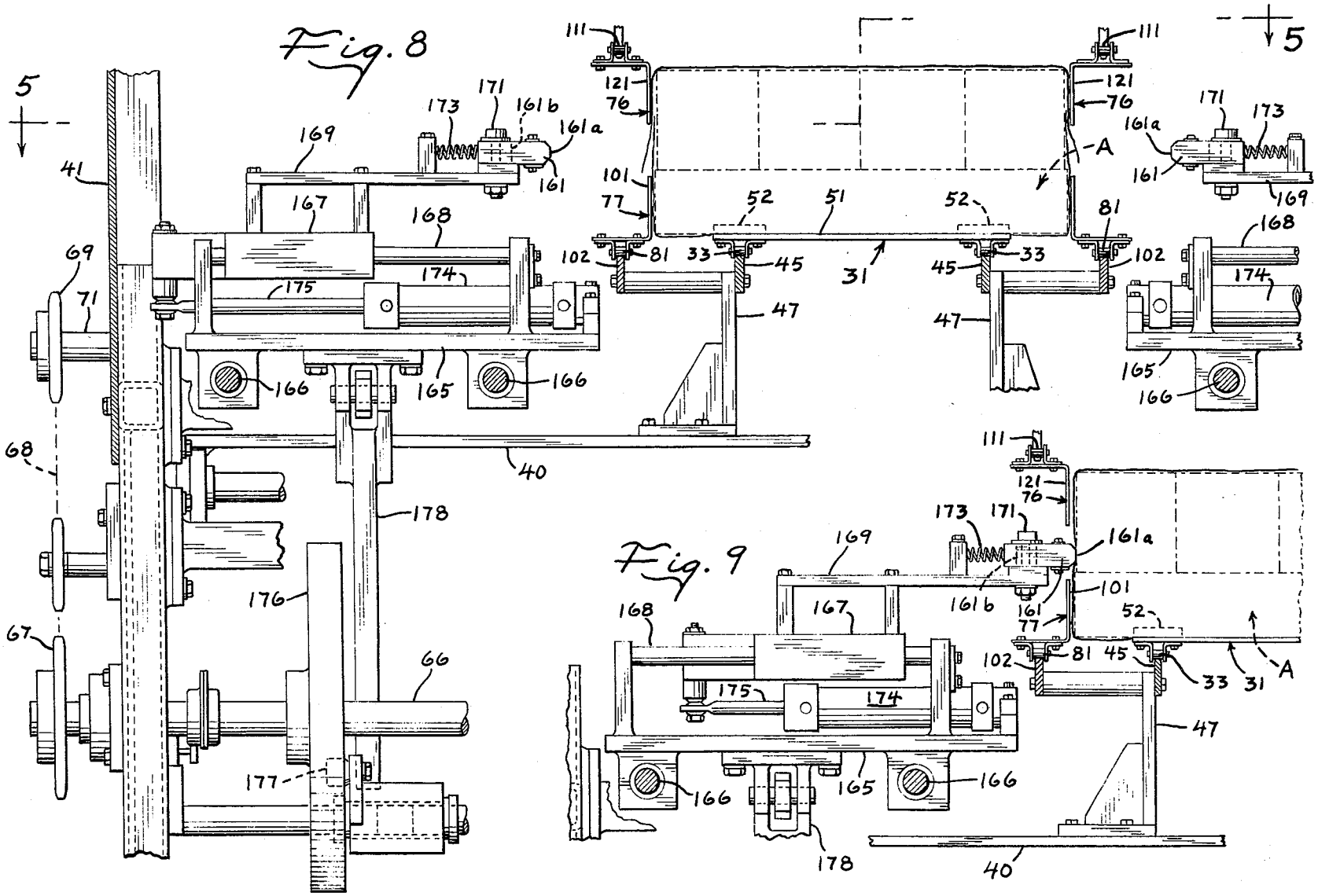
FIG. 8 is a fragmentary transverse sectional view taken on the plane 8—8 of FIG. 6.
FIG. 9 is a fragmentary transverse sectional view taken on the plane 8—8 of FIG. 6 and illustrating the heat sealing apparatus in a moved position thereof.

Provision is made for sealing the overlapping portions of the wrapper together at the ends of the articles as they are advanced. The heat sealing is advantageously effected by means of a sealing member 161 having a sealing face 161*a* arranged to press the overlapping portions of the ends of the wrapper against the ends of the article and to heat seal the same. The heat sealing member is heated by a suitable heating element (not shown) the energization of which heating element is suitably controlled by a thermostat or the like to maintain a preset temperature at the sealing face, and provision is made for sequentially moving the sealing member first laterally of the path of travel of the articles into engagement with the wrapper and then forwardly along the path of travel of the articles to heat seal the overlapping portions together and then laterally away and back to its initial position. For this purpose, the heat sealing member is mounted on a main carriage 165 which is slidably supported on guide rails 166 for movement along a path paralleling the upper run of the article conveyor. An auxiliary conveyor 167 is slidably mounted on guide rails 168 attached to the main carriage for movement in a direction crosswise of the direction of movement of the main carriage and crosswise of the path of travel of the articles on the article conveyor. As best shown in FIGS. 5, 8 and 9, the heat sealing member 161 is mounted on a bracket 169 attached to the auxiliary carriage 167 and the heating member is supported on the bracket 169 as by bolts 171 that extend through elongated openings **161*b* in the heat sealing member. The heat sealing member is yieldably biased to an extended position relative to the bracket 169 by springs 173 which control the sealing pressure on the member 161. The member 161 is disposed at a level to press the overlapping portions of the wrapper against the articles A intermediate the fingers on the upper and lower finger conveyors, while the latter move along their forward run, to heat and seal the overlapping portions of the wrapper together along seal lines indicated at S2 in FIGS. 3 and 4. The auxiliary carriage 167 is moved crosswise of the main carriage 165 as by a fluid cylinder 174 mounted on the main carriage and having its rod 175 connected to the auxiliary carriage. The main carriage is reciprocated lengthwise of the path of travel of the articles as by a cam 176 driven from the cam shaft 66 and having a follower 177 connected through an arm 178 to the main carriage 165. As graphically illustrated in FIG. 10, the cam 176 is arranged to advance the main carriage at a constant velocity indicated by line 176*a* correlative with the speed of the article conveyor through slightly more than 180° of its revolution and, after a short dwell 176*b*, to then retract the main carriage to its initial position as indicated at 176*c* (not shown). A valve conveniently operated off the cam shaft 66 controls operation of the fluid actuator 75 to move the auxiliary carriage laterally toward the article conveyor as indicated at 174*a* in FIG. 10, shortly after the main carriage has commenced its forward movement and to hold the auxiliary carriage in its extended position as indicated at 174*b* until shortly before the end of the forward travel of the main carriage at which time the valve is operated to retract the auxiliary carriage as indicated at 174*c***.

Figure 4:
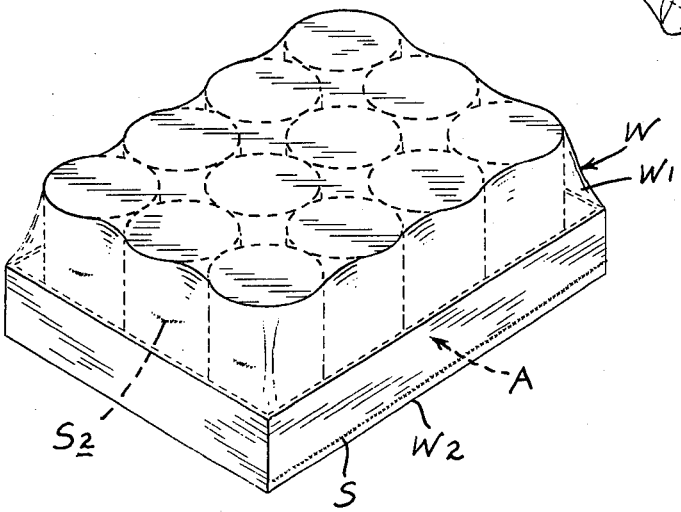
FIG. 4 is a perspective view of the article after the wrapper has been heat shrunk.

After the ends of the wrapper are closed by the wrapper closing apparatus 22, the articles are advanced through the heat tunnel 23 which heats the wrapper either by radiant energy or by hot air to shrink the wrapper as shown in FIG. 4. Such heat tunnnels are well known and detailed description of the construction or operation of the same is deemed unnecessary.

From the foregoing it is felt that the construction and operation of the wrapping apparatus will be readily understood. The articles, which may comprise a single item or a group of items, are first enclosed in a wrapper of heat shrinkable plastic film by the wrapper 21 and the articles are then advanced through the end folding and sealing apparatus 22. The end folding and sealing apparatus operates to sequentially fold the lower and upper portions of the projecting ends of the wrapper into overlapping relation at the ends of the article and to heat seal the overlapping portions together to close the ends of the package. The upper and lower portions of the projecting ends of the wrapper are folded by film folding fingers that project from the finger conveyors and the wiping action of the fingers as they move from the inclined inlet runs to the generally horizontal forward runs tends to wipe out or smooth out any wrinkles or folds that otherwise would occur in the ends of the wrapper. Moreover, the fingers at the lead ends of the group tend to draw the excess material at the forward corners of the articles forwardly so as to avoid overlapping of this material at the ends of the articles. The fingers at the trail ends of the groups of film folding fingers on each the upper and lower finger conveyors are spaced forwardly from the article pushers 52 on the article conveyor, as the fingers move along their forward runs, to avoid folding the excess material at the trail corners of the packages forwardly to avoid overlapping this material at the ends of the articles. This folding of the projecting ends of the wrapper produces only a double layer of material at the end which can be readily and reliably heat sealed by the heat seal member 161 that travels with the articles at a level between the fingers on the upper and lower finger conveyors.

While there has been shown and described a preferred embodiment of the invention, it will be understood that the invention may be embodied otherwise than as herein specifically illustrated and described and that certain changes in the form and arrangement of parts and in the specific manner of practicing the invention may be made without departing from the underlying principles of this invention within the scope of the appended claims.

The embodiments of the invention in which an exclusive property or privilege is claimed are defined as follows:

1. An apparatus for folding and sealing upper and lower end portions of a heat sealable wrapper at the end of articles as the articles are advanced comprising:

a. an endless type article conveyor having an upper run and article pusher means at a preselected pitch distance along the article conveyor for engaging the trailing side of the articles to advance the articles and wrapper in a forward direction along a generally horizontal path of travel with upper and lower end portions of the wrapper extending laterally from the article conveyor;

b. an endless type upper and lower finger conveyors disposed alongside the article conveyor, said upper and lower finger conveyors having inlet runs that converge in said forward direction at a shallow acute angle respectively from above and below said upper run of the article conveyor and forward runs extending forwardly from the respective inlet run in vertically spaced relation, the inlet runs of said upper and lower finger conveyors converging toward the upper run of the article conveyor at locations intermediate the ends thereof and offset in a direction lengthwise of the upper run of the article conveyor whereby to effect sequential folding of the end portions of the wrapper, said upper and lower finger conveyors each having a plurality of film folding fingers extending respectively downwardly and upwardly from the upper and lower finger conveyors as they move along the inlet and forward runs thereof for engaging the upper and lower end portions of the wrapper to fold the same respectively downwardly and upwardly into overlapping relation at the ends of the article, said fingers being arranged in groups at said preselected pitch distance along the respective finger conveyor means for driving the finger conveyors in timed relation with the article conveyor with the fingers at the trailing end of each group of fingers disposed forwardly of the article pusher means on the article conveyor as the article pusher means moves along the forward run of the finger conveyors and c. wrapper seal means for sealing the overlapping upper and lower end portions of the wrapper to each other as the articles are advanced by the article conveyor past said forward runs of the finger conveyors.

2. A wrapper end folding and sealing apparatus according to claim 1 wherein the inlet run of the upper finger conveyor is offset in said forward direction relative to the inlet run of said lower finger conveyor whereby the fingers on the lower finger conveyor engage the lower end portion of the wrapper to fold the same upwardly alongside the articles before the fingers on the upper finger conveyor engage the upper end portion of the wrapper to fold the same downwardly into overlapping relation with the lower portion of the end of the wrapper.

3. A wrapper end folding and sealing apparatus according to claim 2 including blower means for directing a stream of air upwardly alongside the article conveyor adjacent the inlet run of the lower finger conveyor for elevating the upper end portion of wrapper before the fingers on the lower finger conveyor fold the lower end portion of the wrapper upwardly.

4. A wrapper end folding and sealing apparatus according to claim 3 including a suction head extending alongside the path of travel of the articles adjacent the inlet run of the lower finger conveyor for holding upper end portion of the wrapper in a raised position.

5. A wrapper end folding and sealing apparatus according to claim 1 wherein said wrapper seal means includes a heat seal member mounted to engage the overlapping portions of the end of the wrapper at a location intermediate the fingers on the upper and lower finger conveyors as they advance along their forward run.

6. A wrapper end folding and sealing apparatus according to claim 1 wherein said wrapper seal means includes an elongated heat seal member, and means for sequentially moving said heat seal member from an initial position first laterally of said path of travel to press the overlapping upper and lower end portions of the wrapper against the end of the article; then forwardly along said path with the article while the article is advanced by the article conveyor and then laterally away from the path and back to said initial position.

7. A wrapper end folding and sealing apparatus according to claim 6 wherein said heat seal member is mounted to engage said overlapping upper and lower end portions of the wrapper at a location intermediate the fingers on the upper and lower finger conveyors as they advance along said forward run thereof, said sealing member having a length paralleling said forward run which is less than the length of the articles enclosed in the wrapper to seal the overlapping upper and lower end portions of the wrapper in areas intermediate the lead and trail sides of the articles.

8. A wrapper end folding and sealing apparatus according to claim 1 wherein said wrapper seal means includes a main carriage mounted for reciprocatory movement alongside said article conveyor, an auxiliary carriage mounted on the main carriage for movement relative thereto in a direction crosswise the direction of movement of the article conveyor, a heat seal member mounted on said auxiliary carriage at a level intermediate the fingers on the upper and lower finger conveyors as they move along their forward run, means for alternately moving said main carriage forwardly from an initial position at the speed of the upper run of the article conveyor and then rearwardly to its initial position, and means for moving said auxiliary carriage crosswise of the main carriage in timed relation with the reciprocation of the main carriage.

9. A wrapper end folding and sealing apparatus according to claim 8, wherein said last mentioned means includes means for yieldably pressing said heat seal member against the overlapping portions of the wrapper at the end of the article.

10. A wrapper end folding and sealing apparatus according to claim 8 wherein said heat seal member has a length paralleling said path which is less than the length of the articles enclosed in the tubular wrapper.

* * * * *